US007363983B2

(12) United States Patent
Martinez et al.

(10) Patent No.: US 7,363,983 B2
(45) Date of Patent: Apr. 29, 2008

(54) ESP/GAS LIFT BACK-UP

(75) Inventors: Ignacio F. Martinez, Macae (BR); Damián Heber Munõz, Chubut (AR)

(73) Assignee: Baker Hughes Incorporated, Houston, TX (US)

( * ) Notice: Subject to any disclaimer, the term of this patent is extended or adjusted under 35 U.S.C. 154(b) by 223 days.

(21) Appl. No.: 11/105,840

(22) Filed: Apr. 14, 2005

(65) Prior Publication Data

US 2005/0230121 A1 Oct. 20, 2005

Related U.S. Application Data

(60) Provisional application No. 60/561,962, filed on Apr. 14, 2004.

(51) Int. Cl.
*E21B 43/16* (2006.01)
*E21B 43/00* (2006.01)

(52) U.S. Cl. ..... 166/372; 166/369; 166/105

(58) Field of Classification Search ..... 166/369, 166/372, 105

See application file for complete search history.

(56) References Cited

U.S. PATENT DOCUMENTS 3,123,983 A * 3/1964 Sliepcevich ..... 62/47.1
6,138,758 A * 10/2000 Shaw et al. ..... 166/265
6,325,152 B1 * 12/2001 Kelley et al. ..... 166/370
2004/0060707 A1 4/2004 Bearden et al.
2005/0269095 A1 * 12/2005 Fairbanks ..... 166/302
2006/0151178 A1 * 7/2006 Howard et al. ..... 166/369

OTHER PUBLICATIONS

*ESP's and Gas Lift on Long Subsea Tie-Backs—Experiences from Development Challenges in the Gannet E Field*, by P. Holweg, published 7th European ESP Roundtable on Feb. 6, 2002.
*Combined ESP/Gas Lift Completions in High GOR/High Sand Wells on Australian Northwest Shelf*, b;y K.J. Aitken, published SPE Gulfcoast ESP Workshop on Apr. 25, 2001.
*Combined ESP/Auto Gas lift Completion Design—Stag Field*, published 6th European ESP Roundtable on Feb. 15, 2000.
*ESP-Gas Lift Combination—A Successful Trial for the First Time*, published SPE Gulfcoast ESP Workshop on Apr. 28, 1999.
*Production Optimization by Combined Artificial Systems and Its Application*, published SPE Gulfcoast ESP Workshop on Apr. 28, 1999.

* cited by examiner

*Primary Examiner*—Jennifer H. Gay
*Assistant Examiner*—Shane Bomar
(74) *Attorney, Agent, or Firm*—Bracewell & Giuliani LLP

(57) ABSTRACT

A well production system has a string of production tubing with a junction having two legs. A first leg is sealed to the casing by a packer located above well perforations. A submersible pump assembly is secured to a second leg, the pump having an intake in the tubing annulus surrounding the first leg. A gas lift valve is secured to the tubing. A port in the first leg allows well fluid to flow out of the first leg to the intake while in the pumping mode. In the pumping mode, a barrier is placed in the first leg above the port and the port opened to cause well fluid to the pump intake. In the gas lift mode, the port is closed and a barrier is placed between the second leg and the first leg.

16 Claims, 1 Drawing Sheet

ESP/GAS LIFT BACK-UP

This application claims the benefit of U.S. provisional application Ser. No. 60/561,962, filed Apr. 14, 2004.

FIELD OF THE INVENTION

This invention relates in general to oil well production with electrical submersible pumps, and particularly to a system that allows an operator to utilize gas lift for production in the event of failure of the pump.

BACKGROUND OF THE INVENTION

One method of producing a well that lacks sufficient internal pressure to flow naturally is to utilize an electrical submersible pump ("ESP"). A typical pump has a large number of stages, each stage having an impeller and diffuser. A down hole electrical motor mounts to the pump assembly for driving the pump. Normally, the pump assembly is suspended on a string of tubing. A power cable extends along the tubing from a power source at the surface to the motor. The pump has an intake in the well fluid and discharges into the tubing.

Periodically, the pump assembly is pulled to the surface for maintenance or replacement. Normally a workover rig is required to pull the tubing and the pump assembly. In certain areas, particularly remote areas, a workover rig may not be readily available. If the pump assembly fails, the well may have to be shut down for a lengthy time period while waiting for a workover rig.

Gas lift is another type of artificial lift for well production. A gas lift valve or mandrel is placed in the tubing, normally above a packer. The gas lift valve allows fluid flow from the tubing annulus into the tubing but blocks outward flow from the tubing into the tubing annulus. A compressor pumps gas down the tubing annulus through the gas lift valve into the tubing. The gas flows upward in the tubing, reducing the hydrostatic pressure of the well fluid in the tubing. The reduction in hydrostatic pressure induces the well fluid to flow.

Gas lift systems have been employed with ESP systems. In one type, a packer seals the tubing to the casing above the ESP. The gas lift valve is located above the packer. The operator can pump gas down the tubing annulus and into the tubing through the gas lift valve. In the event of pump failure, the operator is able to achieve efficient gas lift production. However, if the well is gassy, this system is not used. An ESP does not efficiently pump well fluid with a significant gas content. In conventional non-gas lift ESP installations for gassy wells, a gas separator is mounted below the pump. The gas separator separates liquid from gas, delivers the liquid to the pump and vents the gas off into the tubing annulus. A gas separator of this type could not be mounted to the ESP below the packer because the vented gas would be blocked by the packer from flowing up the tubing annulus.

Gas lift valves have also been employed in conventional ESP installations that do not use a packer. In those instances, the gas lift valve is located above the ESP. A gas separator can be employed because there is no packer to block vented gas from flowing up the tubing annulus. However, this type of gas lift is not as efficient in the event of pump failure as the type mentioned above because of the lack of a packer separating the tubing annulus from the perforations.

SUMMARY OF THE INVENTION

In this invention, the production tubing has a main section terminating in first and second legs. The first leg is in communication with the well fluid. A pump has a discharge in communication with the second leg and an intake for receiving well fluid to pump through the second leg into the main section while the apparatus is in a pumping mode. A gas lift valve in the tubing admits into the tubing gas pumped down the well to induce the flow of well fluid up the first leg and into the main section while in a gas lift mode.

A barrier selectively blocks flow in the main section from the pump while in the gas lift mode. Another barrier selectively blocks well fluid flow from the first leg into the main section while in the pumping mode. Preferably, a packer is secured to the first leg for sealing engagement in the well above the perforations and below the intake of the pump. The packer has a passage for communicating well fluid with the first leg. A port with a closure member in the first leg selectively allows well fluid flow out of the first leg to the intake of the pump while in the pumping mode.

DETAILED DESCRIPTION OF THE INVENTION

Figure 1:
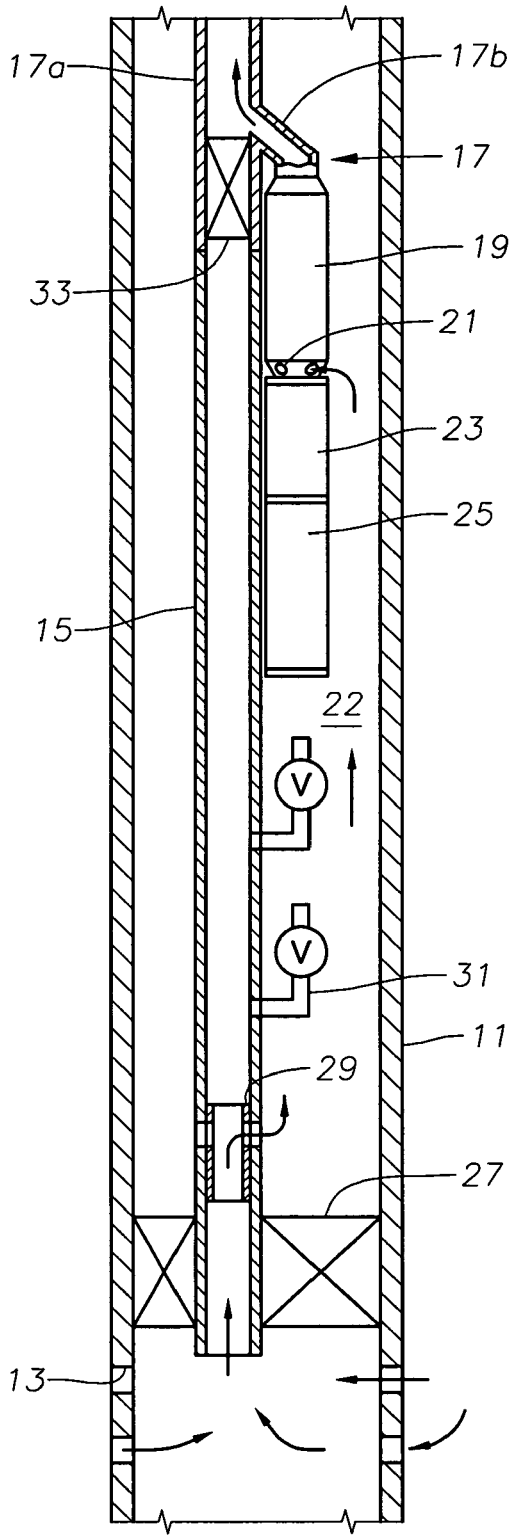
FIG. 1 is a schematic sectional view of a pump and gas lift system in accordance with this invention, showing the system in a pumping mode.

Referring to FIG. 1, a conventional well casing 11 is shown. Casing 11 is cemented in the well and has perforations 13 into which well fluid flows. A string of production tubing 15 extends into the well. Tubing 15 is preferably made up of sections of pipe secured together, each section being about 30 feet in length. Alternately, tubing 15 could be continuous or coiled tubing.

A Y-tool 17 is secured into the main section of the string of tubing 15. Y-tool 17 comprises a junction with a first leg 17*a* being concentric with the axis of tubing 15 and a second leg 17*b* extending laterally at an angle to one side. An electrical submersible pump 19 is mounted to second leg 17*b* of Y-tool 17. Pump 19 extends alongside tubing 15 parallel to tubing 15 and may be secured by straps. Pump 19 preferably comprises a centrifugal pump having a plurality of stages of impellers and diffusers and an intake 21 at its lower end that draws well fluid from a tubing annulus 22 surrounding first leg 17*a*.

If the well produces a significant amount of gas, a gas separator (not shown) of conventional design can be mounted below pump 19. Gas separated by the gas separator is vented into tubing annulus 22, where it can flow to the surface. Other types of pumps are feasible. Also, it is not critical that first leg 17*a* be concentric with the axis of tubing 15.

A seal section 23 secures to the lower end of pump 19. An electrical motor 25 secures to the lower end of seal section 23. Motor 25 and seal section 23 are filled with a dielectric lubricant, and seal section 25 equalizes the lubricant pressure with the hydrostatic pressure in casing 11.

First leg 17*a* of tubing 15 has a stinger portion on its lower end that stabs sealingly into a packer 27 installed in casing 11. Packer 27 seals the stinger portion of first leg 17*a* of tubing 15 to casing 11 and is located above perforations 13.

Figure 2:
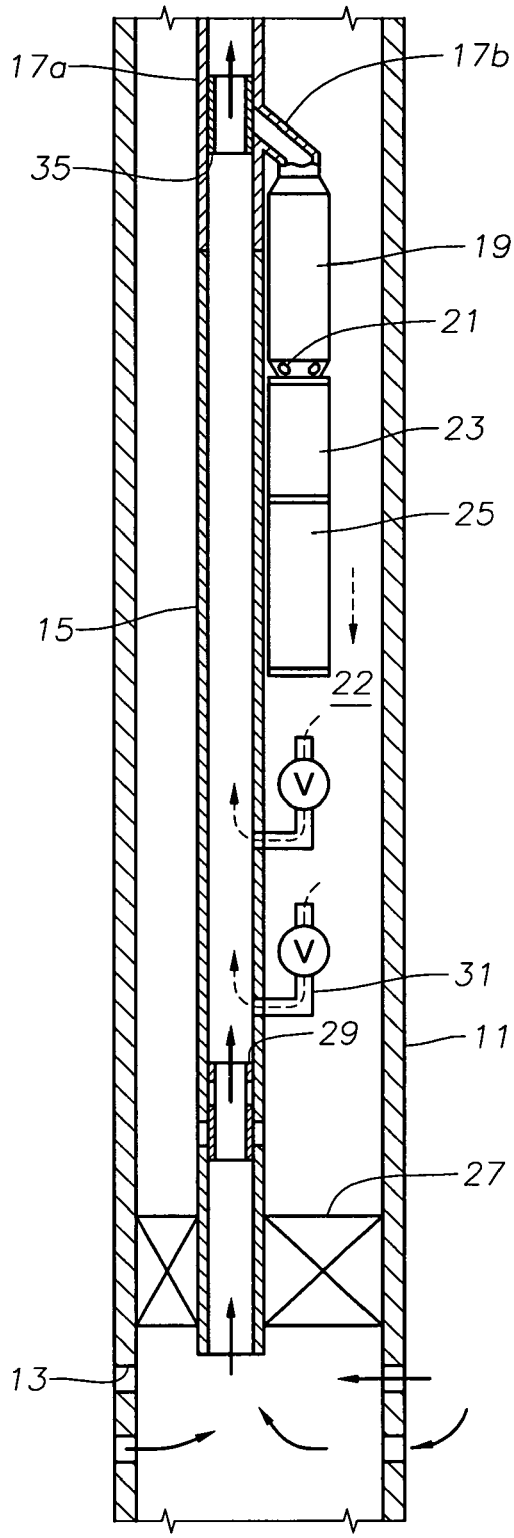
FIG. 2 is a schematic sectional view of the system of FIG. 1, shown with the system in a gas lift mode.

The lower end of first leg 17*a* is open. A port with a closure member, preferably a sliding sleeve 29, is located in first leg 17*a* of tubing 15 above packer 27. Sliding sleeve 29 has an open position wherein it communicates the interior of first leg 17*a* with tubing annulus 22. The open position is shown in FIG. 1, and the closed position is shown in FIG. 2. Sliding sleeve 29 is conventional and is typically moved from the open to the closed position by lowering a wireline tool into engagement with it and pulling upward. Alternately, sliding sleeve 29 could be hydraulically or electrically actuated.

Conventional gas lift valves 31 are shown connected to first leg 17*a* of tubing 15 below Y-tool 17, but they could be connected to the main section of tubing 15 above Y-tool 17. Gas lift valves are conventional devices that will admit to tubing 15 pressurized gas pumped down tubing annulus 22 from the surface. The gas returns up tubing 15, reducing the hydrostatic pressure of liquid in tubing 15 and inducing the flow of liquid from perforations 13. Gas lift valves 31 will not allow fluid flow from the interior of tubing 15 into tubing annulus 22.

In the pumping mode of the system as shown in FIG. 1, sliding sleeve 29 will be open, and a barrier such as a blanking plug 33 is installed in first leg 17*a* above gas lift valves 31 and below the junction of second leg 17*b* with tubing 15. Blanking plug 33 is a conventional barrier of a type that is typically installed on a wireline or coiled tubing. A valve could alternately be utilized rather than blanking plug 33. Electrical power is supplied by a cable (not shown) to motor 25. Motor 25 drives pump 19, which causes well fluid to flow from perforations 13 through the port of sliding sleeve 29 and into tubing annulus 22. The well fluid flows into intake 21 and is discharged by pump 19 into tubing 15 above blanking plug 33. Gas lift valves 31 perform no function while pump 19 is operating. Gas is not pumped down tubing annulus 22 while pump 19 is operating.

In the event that pump 19, seal section 23 or motor 25 fails or requires maintenance, the operator may stop the supply of power to motor 25 and shift to the gas lift mode. The operator removes blanking plug 33 with a wireline tool. The operator also uses a wireline tool to move sliding sleeve 29 to the closed position shown in FIG. 2. The operator installs another barrier, preferably an isolation sleeve 35, in second leg 17*b*. Isolation sleeve 35 blocks flow from first leg 17*a* into second leg 17*b* but allows flow through first leg 17*a*. The operator then uses a compressor to pump gas down tubing annulus 22. The gas flows through gas lift valves 31 and back up tubing 15. The gas flow reduces the hydrostatic pressure of the fluid in tubing 15, which induces a flow of well fluid from perforations 13 up tubing 15. The gas and well fluid flow through isolation sleeve 35 and to the surface, where the gas is separated.

The invention has significant advantages. The gas lift allows the well to continue under production in the event of pump failure. Locating the packer below the pump allows a gas separator to be incorporated with the pump.

While the invention has been shown in only one of its forms, it should be apparent to those skilled in the art that it is not so limited but is susceptible to various changes without departing from the scope of the invention.

We claim:

1. An apparatus for producing a well, comprising:

a string of tubing for installation in the well, the tubing having a main section terminating in first and second legs, the first leg adapted to be in communication with the well fluid;

a pump having an outlet in communication with the second leg and an intake for receiving well fluid to pump through the second leg into the main section while the apparatus is in a pumping mode;

a gas lift valve in the tubing for admitting into the tubing gas pumped down the well to induce the flow of well fluid up the first leg and into the main section while in a gas lift mode; and a second leg barrier that selectively blocks the outlet of the pump from communication with the main section of the tubing while in the gas lift mode.

2. The apparatus according to claim 1, further comprising:

a first leg barrier that selectively blocks well fluid flow from the first leg into the main section while in the pumping mode.

3. The apparatus according to claim 1, further comprising:

a packer secured to the first leg for sealing engagement in the well above perforations in the well and below the intake of the pump, the packer having a passage for communicating well fluid with the first leg;

a port with a closure member in the first leg for selectively allowing well fluid flow out of the first leg to the intake of the pump while in the pumping mode.

4. The apparatus according to claim 1, wherein the pump comprises a centrifugal submersible pump assembly.

5. The apparatus according to claim 1, wherein the second leg barrier comprises:

a retrievable sleeve that is selectively installed in a junction with the second leg and the main section.

6. The apparatus according to claim 1, further comprising:

a retrievable plug that is selectively installed in the first leg to block communication of the first leg with the main section while in the pumping mode.

7. The apparatus according to claim 1, further comprising:

a packer engageable by the first leg for sealing engagement in the well above perforations in the well and below the intake of the pump, the packer having a passage for communicating well fluid with the first leg;

a first leg barrier that selectively blocks well fluid flow from the first leg into the main section while in the pumping mode; and a port with a closure member in the first leg for selectively allowing well fluid flow out of the first leg to the intake of the pump while in the pumping mode and while the first leg barrier is blocking well fluid flow from the first leg into the main section.

8. In a well having casing containing perforations, a string of tubing extending within the casing, defining a tubing annulus, and a packer that seals a lower portion of the tubing to the casing above the perforations, an apparatus for producing well fluid comprising:

a junction in the tubing, defining a laterally extending leg;

a submersible pump assembly secured to the leg and having an intake above the packer in a tubing annulus surrounding the tubing;

a port with a closure member in the tubing above the packer, having an open position that enables well fluid from the perforations to flow out of the tubing into the tubing annulus, and from the tubing annulus into the intake of the pump while the apparatus is in the pumping mode;

a first barrier selectively located in the tubing below the junction while the apparatus is in the pumping mode to block well fluid discharged by the pump from flowing down the tubing;

a gas lift valve secured to the tubing for flowing gas pumped down the tubing annulus into the tubing while the apparatus is in the gas lift mode;

the closure member having a closed position that causes well fluid from the perforations to flow up the tubing while the system is in the gas lift mode; and a second barrier selectively located in the junction to block fluid flowing up the tubing from entering the pump assembly while the system is in the gas lift mode.

9. The well according to claim 8, wherein the first barrier comprises a retrievable plug.

10. The well according to claim 9, wherein the second barrier comprises a movable sleeve.

11. The well according to claim 9, wherein the closure member comprises a sliding sleeve.

12. A method of producing a well, comprising:

(a) providing a string of tubing with a main section and first and second legs;

(b) connecting a pump to the second leg;

(c) mounting a gas lift valve to the tubing;

(d) lowering the tubing, pump and gas lift valve into the well;

(e) in a pumping mode, operating the pump and pumping well fluid through the second leg into the main section of the tubing; and (f) in a gas lift mode, stopping operation of the pump, delivering gas down the tubing annulus and through the gas lift valve to induce well fluid to flow up the first leg into the main section of the tubing while the pump is not operating, and blocking the second leg from well fluid flowing up the first leg.

13. The method according to claim 12, wherein step (e) further comprises placing a barrier in the first leg to block well fluid discharge by the pump from flowing down the first leg.

14. The method according to claim 12, further comprising:

setting a packer between the first leg and casing in the well;

providing a port with a closure member in the first leg above the packer; and step (e) comprises:

opening the closure member and causing well fluid to flow from below the packer, out the port, and to an intake of the pump in an annulus surrounding the first leg.

15. The method according to claim 14, wherein step (f) comprises closing the closure member to cause well fluid to flow up the first leg to the main section.

16. The method according to claim 12, further comprising:

setting a packer between the first leg and casing in the well;

providing a port with a closure member in the first leg above the packer; and step (e) further comprises:

opening the closure member and placing a barrier in the first leg above the closure member, causing well fluid to flow out the port to an intake of the pump in an annulus surrounding the first leg; and step (f) further comprises closing the closure member, removing the barrier in the first leg, and blocking the second leg from well fluid flowing up the first leg.

* * * * *